US006739748B2

(12) United States Patent
Della Santa

(10) Patent No.: US 6,739,748 B2
(45) Date of Patent: May 25, 2004

(54) WRISTWATCH HAVING SLIDING SHUTTER-TYPE COVERS

(75) Inventor: Richard Della Santa, La Chaux-de-Fonds (CH)

(73) Assignee: Leon Hatot SA, Neuchâtel (CH)

( * ) Notice: Subject to any disclaimer, the term of this patent is extended or adjusted under 35 U.S.C. 154(b) by 216 days.

(21) Appl. No.: 09/987,727

(22) Filed: Nov. 15, 2001

(65) Prior Publication Data

US 2002/0064100 A1 May 30, 2002

(30) Foreign Application Priority Data

Nov. 29, 2000 (EP) ..... 00204245

(51) Int. Cl.[7] ..... G04B 37/00
(52) U.S. Cl. ..... 368/283; 368/276
(58) Field of Search ..... 368/223, 228, 368/262, 276, 283, 281

(56) References Cited

U.S. PATENT DOCUMENTS 1,907,700 A * 5/1933 Alix ..... 368/276
2,236,650 A * 4/1941 Pujol ..... 368/283
2,636,338 A * 4/1953 Dinstman ..... 368/283
3,444,685 A * 5/1969 Juillerat ..... 368/276
4,236,239 A * 11/1980 Imgruth et al. ..... 368/276
4,941,137 A * 7/1990 Kikuchi ..... 368/223
5,161,130 A * 11/1992 Sato et al. ..... 368/228
5,805,535 A * 9/1998 Guyard et al. ..... 368/283
5,881,029 A * 3/1999 Kuo ..... 368/262
6,229,768 B1 * 5/2001 Nakazawa et al. ..... 368/223

FOREIGN PATENT DOCUMENTS

| | | |
|---|---|---|
| CH | 144 055 | 12/1930 |
| CH | 331 285 | 7/1958 |
| CH | 337 138 | 3/1959 |
| CH | 345 5608 | 3/1960 |

* cited by examiner

*Primary Examiner*—David Martin
*Assistant Examiner*—Jeanne-Marguerite Goodwin
(74) *Attorney, Agent, or Firm*—Sughrue Mion, PLLC

(57) ABSTRACT

The wristwatch of substantially rectangular shape includes two sliding shutter-type covers (6, 7) sliding over a case (1) to show or to conceal said case via manual action exerted on said shutters. The shutters are secured to the case by holding means (9) distinct from the guide means (8), said means being implemented to exert a vertical force (F) under each of the shutters tending to apply said shutters (6, 7) against the holding means (9) to reduce the shutter friction surface on the case.

10 Claims, 4 Drawing Sheets

WRISTWATCH HAVING SLIDING SHUTTER-TYPE COVERS

BACKGROUND OF THE INVENTION

The present invention relates to a wristwatch of substantially rectangular shape including a case enclosing a movement, a wristband whose first strand is fixed onto a first side of the case and whose second strand is fixed onto the opposite side to the first, and two sliding shutter-type covers (hereinafter "shutters") sliding over the case and capable of being open or closed to allow said case to appear or to be concealed respectively via manual action exerted on the shutters, guide and holding means being implemented to secure each of said shutters firmly to the case.

Abundant literature may be cited describing wristwatches fitted with sliding shutters. For example, Swiss Patent No. 144 055 discloses a timepiece comprising a watch with an aperture. This timepiece is characterised by two sliding shutters normally covering the aperture and guided into two slide-ways arranged in the case. Swiss Patent No. 337 138 is another example which may be cited wherein the wristwatch disclosed includes a sliding cover. In this document, the case is rectangular and has at its ends two studs onto each of which is hinged one of the ends of a wristband. The cover has an arc-shaped cross section, the longitudinal edges of the cover being engaged in guide grooves, which hold the cover, each arranged in the outer flank of a longitudinal edge of the middle part flanking the aperture of the protective crystal. A longitudinal groove is made in the outer flank of each edge, penetrated by a listel formed inside the longitudinal edge of the arc-shaped cover. The groove and the listel preferably have a triangular-shaped cross section.

In the two aforecited examples, as in numerous documents which the Applicant has been able to examine, the edge of the shutter or listel with which it is provided, rubs against the slide-way or groove arranged in the watch case, over its entire length and over all its surfaces. Moreover, in the documents consulted, the means for holding the shutter on the case are merged with the means for guiding said shutter on said case. This has the drawback of leading to a significant friction surface and consequently a significant friction force which the manual force of the person wearing the watch will have to overcome in order to open or close the shutter. It will also be noted that this friction force will tend to increase as the elements sliding into each other become dirty, such dirt being due for example to the combination of dust associated with the perspiration of the person wearing the watch.

SUMMARY OF THE INVENTION

It will be understood that the aforementioned drawbacks may be greatly reduced if one manages to reduce the effect of friction of the elements present, in particular by providing holding means which are separate from the guide means, the construction being arranged so that the friction forces essentially only affect the holding means, which is the main object of the present invention. The documents consulted on the means for holding the shutter on the case are merged with the means for guiding said shutter on said case. In order to do this the invention is characterised in that said guide and holding means are distinct from one another and in that means are implemented to exert a vertical force under each of the shutters tending to apply said shutter against said holding means.

BRIEF DESCRIPTION OF THE DRAWINGS

Further innovations in addition to those cited above are also added to the opening and closing mechanism for the shutter in question and will be described hereinafter.

DETAILED DESCRIPTION OF THE INVENTION

Figure 1:
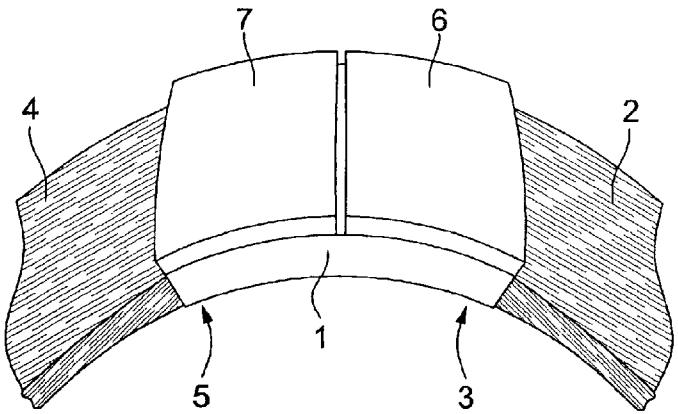
FIG. 1 is a perspective view of the wristwatch of the invention shown with its shutters closed.
Figure 2:
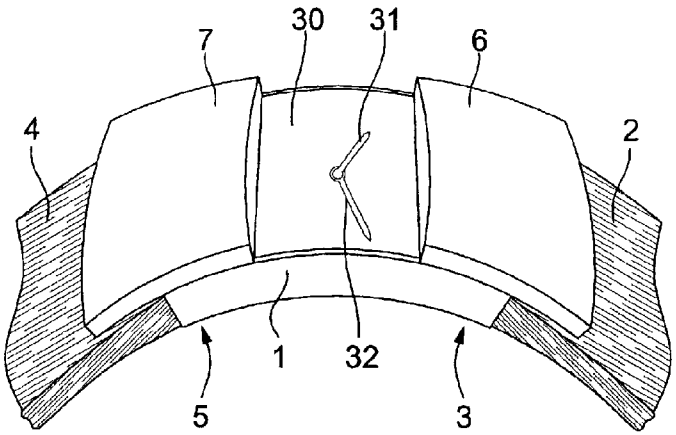
FIG. 2 is a perspective view of the wristwatch of the invention shown with its shutters open.

The wristwatch shown in FIGS. 1 and 2 has a substantially rectangular shape. It includes a case 1 enclosing a movement (not shown) above which is mounted a dial 30 above which the hour hand 31 and minute hand 32 move. The watch also includes a wristband whose first strand 2 is fixed onto a first side 3 of case 1 and whose second strand 4 is fixed onto a second side 5 opposite the first side. Two shutters 6 and 7 slide over case 1 and can be open or closed respectively to allow case 1 to appear (FIG. 2) or be concealed (FIG. 1), via manual action exerted on shutters 6 and 7. As is clear in FIG. 4, each of shutters 6 and 7 (here shutter 6) is secured to case 1 by guide and holding means 8 and 9, which will be described in detail hereinafter.

Figure 4:
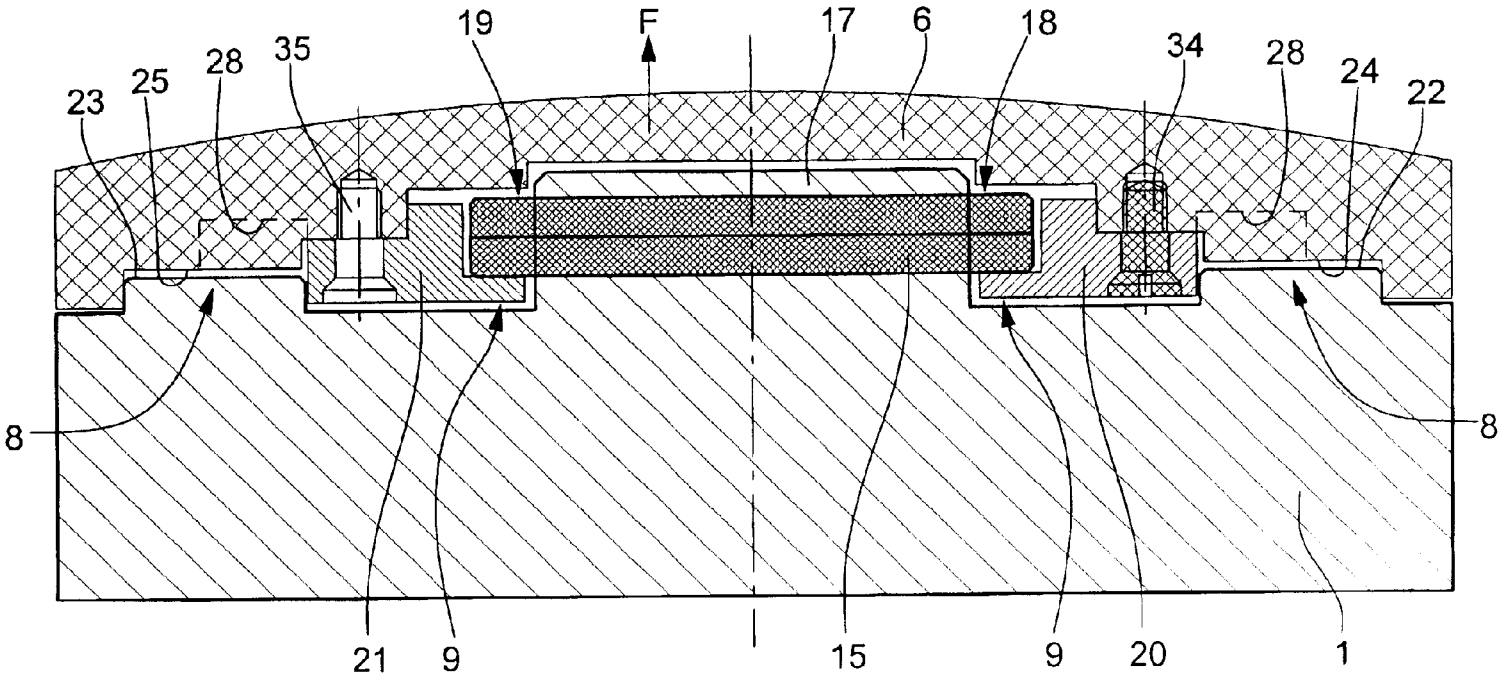
FIG. 4 is a cross-section in the shutter and the watch case shown in FIG. 2, the cross-section being made along a direction perpendicular to the longitudinal direction of the wristband.

The wristwatch with shutter-type covers differs from the prior art in that guide means 8 are distinct from the holding means as is shown clearly in FIG. 4, which allows shutters 6 and 7 each to be applied against holding means 9 only if means are implemented to exert a vertical force F under each of the shutters. It will thus be understood that the friction surface between the shutters and the case is greatly reduced if compared to the friction surface seen in the aforecited documents. Consequently, this will make opening the shutter easier and will require less manual energy.

Figure 3:
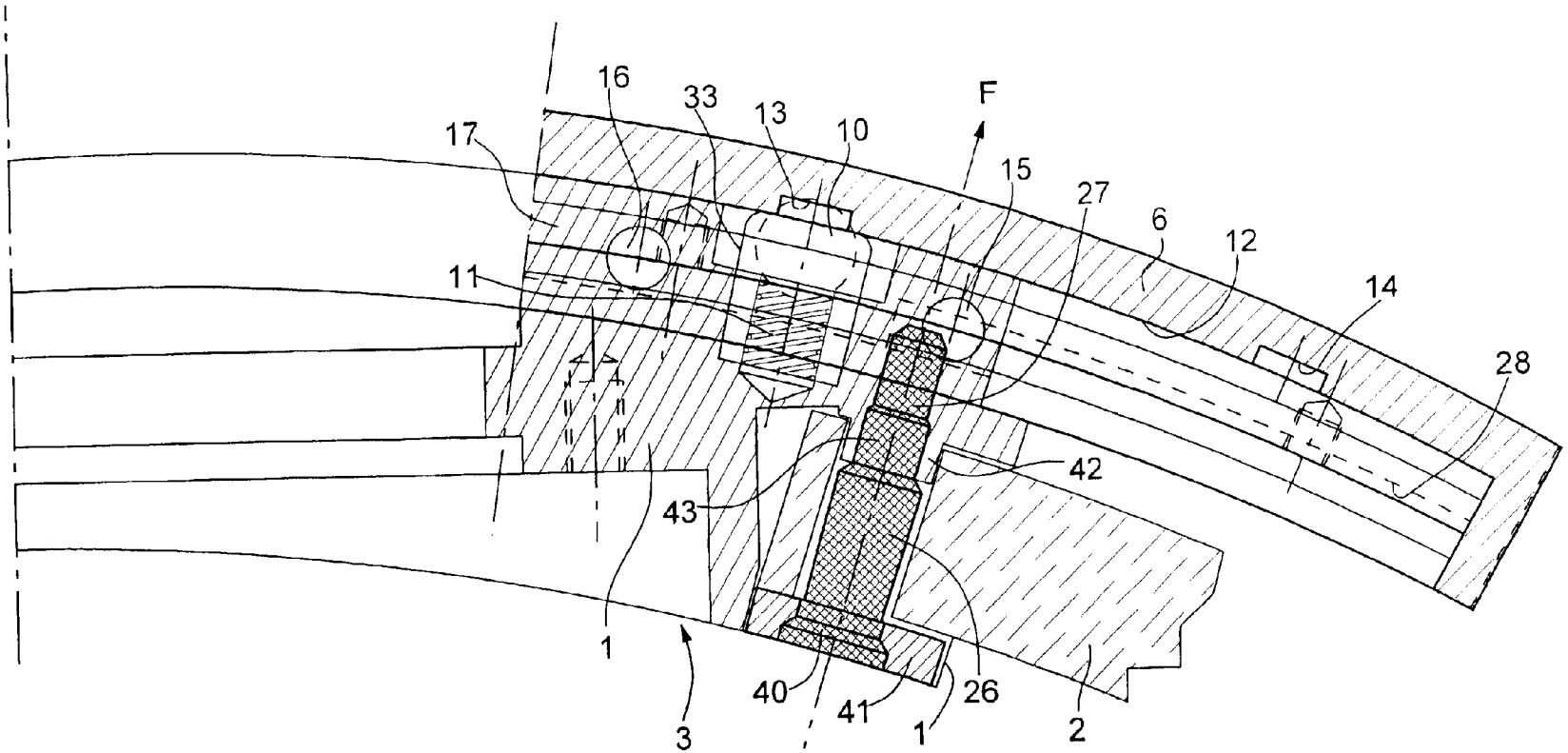
FIG. 3 is a cross-section in the shutter and the watch case shown in FIG. 2, the cross-section being made along a direction parallel to the longitudinal direction of the wristband.

Different methods may be used to exert the required force F. Reference will be made to one such method which is preferred by the Applicant and which consists in using a ball 10 arranged under shutter 6, this ball being secured to case 1 and pushed by a spring 11, as is seen in FIG. 3. The ball is held in a tube 33 driven into the case. A crimp connection arranged in the top of tube 33 allows the top of the ball to appear while preventing the latter from slipping out of the tube. Spring 11 is arranged between the bottom of the tube and the lower part of the ball.

When shutter 6 passes from the open position which is shown in FIG. 3, to the closed position, ball 10 travels under the shutter (see also FIG. 5) along a path 12 in the ends of which are made a first housing 13 and a second housing 14 in which ball 10 is able to enter partially to lock shutter 6 respectively in its open and closed positions. Thus, in the open position of shutter 6, ball 10 is in housing 13. When a force is exerted from right to left on shutter 6, ball 10 leaves its housing 13 and moves along path 12 until it drops into housing 14 which marks the closing of the shutter. It will be noted here that by moving into housings 13 or 14, ball 10 makes a clicking sound which alerts the person wearing the watch that the operation has finished while giving him the impression of possessing a well made object.

In order to prevent grinding the material on which it rubs, ball 10 is made of a hard material and preferably a ceramic material. Such a choice ensures that the mechanism has a very long lifetime before signs of weakness appear in the form of hard points or scratching during the shutter opening and closing movements.

Holding means 9 keeping each shutter 6 and 7 on case 1 will be described hereinafter. They comprise pins engaged in grooves. As FIGS. 4, 5 and 6 show, these holding means 9 include at least two cylindrical pins 15 and 16 whose ends emerge on either side of a listel 17 secured to case 1, and two grooves 18 and 19 made in shutter 6 and located on either side of listel 17, the ends of pins 15 and 16 engaging in said grooves.

Figure 5:
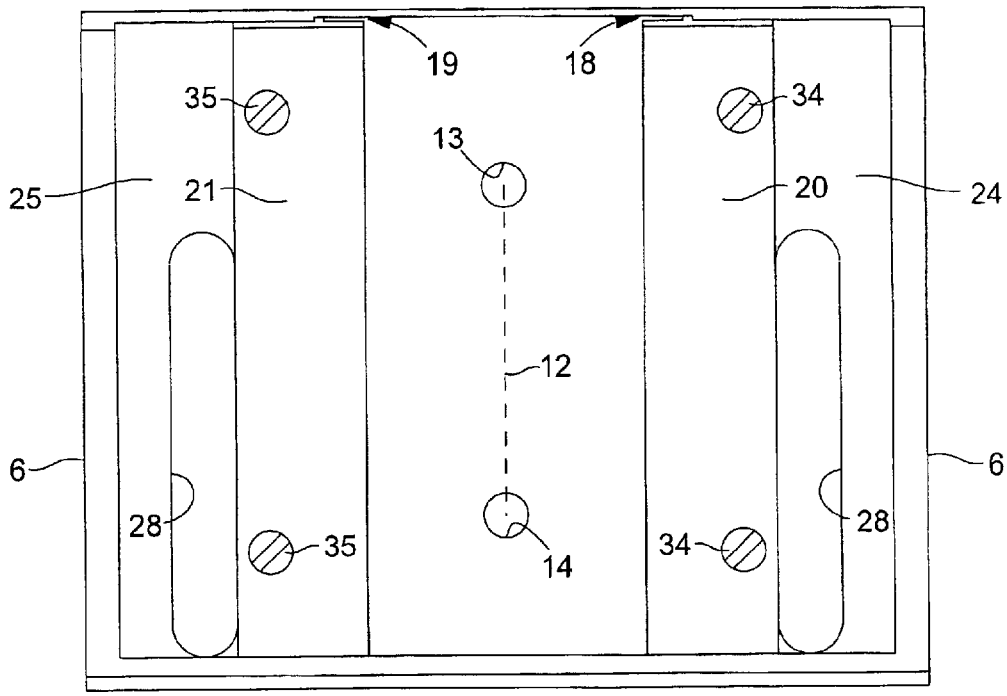
FIG. 5 is a top view of one of the shutters fitted to the watch of the invention.

As FIGS. 4 and 5 show, groove 18 may be formed of a rail 20 added underneath shutter 6 by means of screws 34 and groove 19 formed of a rail 21 added underneath shutter 6 by means of screws 35.

Although this is not shown, it will be noted that in order to facilitate assembly and to prevent pins 15 and 16 from inadvertently slipping out of their housing when shutter 6 is mounted on side 3 of case 1, these pins 15 and 16 can be held in listel 17 by a resilient sealing gasket, i.e. an O-ring housed in a circular groove made in the listel and surrounding the pin.

Figure 6:
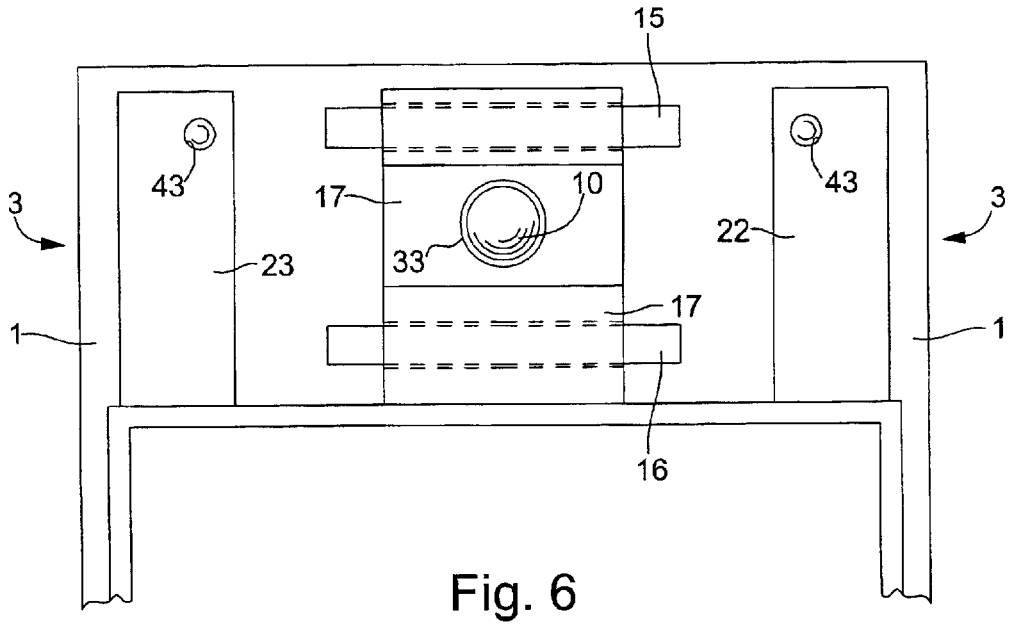
FIG. 6 is a top view of one of the sides of the watch case arranged to accommodate the shutter of FIG. 5.

Guide means 8 guiding each shutter 6 and 7 on the side onto which it is held are shown in FIGS. 4, 5 and 6. These guide means include two rails 22 and 23 emerging from case 1, each of these rails being engaged in a groove 24, respectively 25, made in shutter 6. It can be seen clearly here that guide means 8 are independent and thus distinct from holding means 9 which were described previously.

Examining FIG. 4 more particularly now, it can be seen that shutter 6 pushed by force F due to ball 10 is moved upwards, so that only pins 15 and 16 which form an integral part of case 1 rest on shutter 6 via rails 20 and 21.

When the shutter is opened or closed, the friction between the case and shutter is transferred to the lines of contact existing between pins 15 and 16 and rails 20 and 21 and thus onto the generator lines of said pins. This results in an extremely reduced friction surface which makes opening and closing the shutter easier and thus much more gentle. An examination of FIG. 4 also shows that guide means 8 formed by rails 22 and 23 co-operating with grooves 24 and 25 respectively, does not add any friction since force F referred to hereinbefore arranges a free space between the rails and grooves. It is thus clear that the construction which has just been described allows a carefully made high quality product to be proposed, which seems a necessity if the case and shutters are made of precious metal.

This description will end by highlighting another peculiar feature of the present invention. This concerns the attachment of the strands to the wristband which is achieved, as FIG. 3 shows clearly, by means of screws 26 which are used both to prevent shutter 6 from being released from case 1 and to limit the travel of said shutter.

In order to do this, two screws 26, whose heads 40 rest on a transverse bar 41, pass through the end of wristband strand 2. Screws 26 pass through said bar 41 then the end of strand 2 to be screwed into a projecting portion 42 of case 1. Projecting portion 42 includes an internal screw thread 43 into which screw 26 is screwed. Screw 26 ends in an end or extension 27 which emerges from case 1 and engages in a machined portion 28 made in shutter 6 to limit thereby the travel of the shutter and prevent it from being released from the case. Thus, it will be understood that the assembly of the shutter on the case will have to precede the assembly of the wristband strand onto said case.

What is claimed is:

1. A wristwatch of substantially rectangular shape comprising:

a case having a first side and a second side, and enclosing a movement;

a wristband having a first strand fixed onto said first side of the case, and a second strand fixed onto said second side opposite to the first side;

two sliding shutters slidable over the case and being open or closed to allow said case to appear or to be concealed, respectively, via manual action exerted on said sliding shutters, means for guiding said sliding shutters in translation onto said case; and means for holding said sliding shutters secured onto the case while allowing them to slide onto said guiding means, wherein said guiding means and said holding means are physically separate from each other; and means for exerting a vertical force under each of said sliding shutters, said means for exerting said vertical force being interposed between said case and each of said sliding shutters and tending to apply each of said sliding shutters against said holding means.

2. The wristwatch according to claim 1, wherein said means for exerting said vertical force consist of a ball arranged under each of the sliding shutters, each said ball being secured to the case and pushed by a spring.

3. The wristwatch according to claim 2, wherein each of the balls is made of a hard material, in particular a ceramic material.

4. The wristwatch according to claim 2, wherein each sliding shutter has a top face and a bottom face, wherein each said ball travels under the sliding shutters along a path on said bottom face, wherein said path has two opposite ends, wherein a first housing is provided at one of said ends, and a second housing is provided at the other of said ends, and wherein each said ball enters partially into said first and second housings to lock said sliding shutters respectively in its open and closed positions.

5. The wristwatch according to claim 1, wherein said means for holding each of the sliding shutters onto the case include at least two cylindrical pins whose ends emerge on either side of a listel secured to the case, and two grooves made in the sliding shutters and located on either side of the listel, the ends of said pins engaging in said grooves.

6. The wristwatch according to claim 5, wherein each of the grooves is formed of a rail added underneath the sliding shutters.

7. The wristwatch according to claim 5, wherein each pin is held in the listel by a sealing gasket made of resilient material.

8. The wristwatch according to claim 1, wherein said guiding means include two rails emerging from the case, each of said rails engaging in a groove in the sliding shutters.

9. The wristwatch according to claim 1, wherein first and second wristband strands are secured to the case by means of screws used both to prevent the sliding shutters from inadvertently being released from the case and to limit the travel of said sliding shutters.

10. The wristwatch according to claim 9, wherein an end of each of the screws is engaged in a machined portion in the sliding shutters.

* * * * *